US006348260B1

(12) United States Patent
Ogawa et al.

(10) Patent No.: US 6,348,260 B1
(45) **Date of Patent: *Feb. 19, 2002**

(54) HEAT TRANSFER WHITE-IMAGE-PRINTING SHEET

(75) Inventors: Keiichi Ogawa; Shuji Kobayashi, both of Tokyo (JP)

(73) Assignee: Dai Nippon Printing Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/827,508

(22) Filed: Mar. 28, 1997

Related U.S. Application Data

(63) Continuation of application No. 08/443,552, filed on May 18, 1995, now abandoned.

(30) Foreign Application Priority Data

May 20, 1994 (JP) ..... 6-129854

(51) Int. Cl.[7] ..... B41M 5/26

(52) U.S. Cl. ..... 428/327; 428/195; 428/206; 428/913; 428/914

(58) Field of Search ..... 428/323, 327, 428/328, 195, 488.1, 488.4, 206, 913, 914

(56) References Cited

U.S. PATENT DOCUMENTS 4,880,324 A * 11/1989 Sato et al. ..... 428/195
4,972,000 A * 11/1990 Kawashima et al. ..... 521/54
5,378,534 A * 1/1995 Kurownagi et al. ..... 428/327

FOREIGN PATENT DOCUMENTS

EP 00331421 A2 * 9/1989
JP 02-92939 * 4/1990

OTHER PUBLICATIONS

Patent Abstracts of Japan. vol. 14, No. 393 (M–1015), JP 2147397 Jun./1990, Ko et al.

Derwent Publications Ltd., Week 9212, JP–A–4029887, Jan./1992.

Patent Abstracts of Japan, vol. 11, No. 213 (M–605) Jul. 1987 & JP–A–62 028289, Feb./1987.

Derwent Publications Ltd., Week 9407, JP 6008657, Jan./1994.

Patent Abstracts of Japan, vol. 11, No. 39 (M–559) Feb. 1987, & JP–A–61 206 697, Sep./1986.

Derwent Publications Ltd., Week 9243, JP–A–4 258677, Sep./1992.

Derwent Publications Ltd., Week 8846, JP 63243180, Oct./1988.

* cited by examiner

*Primary Examiner*—Pamela R. Schwartz
(74) *Attorney, Agent, or Firm*—Parkhurst & Wendel, L.L.P.

(57) ABSTRACT

A heat transfer white-image-printing sheet including a substrate film, and a white ink layer including a resin as a main component of the binder thereof and fine hollow particles, provided on one surface of the substrate film. This printing sheet can produce, with high sensitivity, an image having sufficiently high white-color density and hiding power, and excellent abrasion resistance.

2 Claims, 1 Drawing Sheet

HEAT TRANSFER WHITE-IMAGE-PRINTING SHEET

This is a Division of application Ser. No. 08/443,552 filed May 18, 1995, now abandoned.

BACKGROUND OF THE INVENTION

The present invention relates to a heat transfer printing sheet, and, more specifically, to a heat transfer white-image-printing sheet having high hiding power, capable of producing images which are excellent in abrasion resistance.

A conventional resin type heat transfer printing sheet which comprises a resin as the binder of the ink layer thereof is excellent in film-forming properties. However, when sensitivity and printability are taken into consideration, the ink layer of the printing sheet of this type cannot be formed by coating such an amount of an ink that is required to impart thereto sufficiently high hiding power. For this reason, a wax-type heat transfer printing sheet which comprises a wax as a main component of the binder of the ink layer thereof has been applied to a heat transfer white-image-printing sheet which is required to have hiding power. This is because when a wax is used as the binder, an increased amount of an ink can be coated to form the ink layer, an image with good edge definition can be obtained by heat transfer printing, and hiding power can be imparted to the printing sheet.

However, there has been such a problem in that although the wax-type heat transfer printing sheet can have hiding power higher than that of the resin-type sheet, an image produced by the wax-type sheet is poor in both abrasion resistance and heat resistance. An object of the present invention is to provide a heat transfer white-image-printing sheet having sufficiently high hiding power, capable of producing images which are excellent in abrasion resistance and heat resistance. We have made earnest studies in order to attain this object, and, as a result, found that a heat transfer white-image-printing sheet having sufficiently high hiding power and excellent printability, capable of producing images which are excellent in abrasion resistance and heat resistance can be obtained by providing a white ink layer comprising a resin as a main component of the binder thereof and fine hollow particles, or by successively providing a white ink layer comprising a resin as a main component of the binder thereof, and a layer comprising fine hollow particles.

A heat transfer printing sheet comprising fine hollow particles in an ink layer has been conventionally disclosed in Japanese Laid-Open Patent Publication No. 147397/1990. This publication discloses fine hollow particles whose wall are made from a shape memory resin which expands to the original shape thereof by heat applied thereto when printing is conducted. As a result image can be printed even on paper having a rough surface without causing partial deletion or void. In contrast, in the present invention, fine hollow particles containing a gas therein are incorporated into a white ink layer to improve the hiding power of a heat transfer printing sheet. The present invention is thus substantially different from the above application in technical field.

SUMMARY OF THE INVENTION

An object of the present invention is to provide a heat transfer white-image-printing sheet having sufficiently high hiding power, being free from flaking, capable of providing a printed material which is excellent in both abrasion resistance and heat resistance.

The above object can be attained by a heat transfer white-image-printing sheet of the present invention, which comprises a substrate film, and a white ink layer comprising a resin as a main component of the binder thereof, a white pigment and fine hollow particles, provided on one surface of the substrate film; or comprises a substrate film, a white ink layer comprising a resin as a main component of the binder thereof and a white pigment, provided on one surface of the substrate film, and a heat-sensitive adhesion layer comprising fine hollow particles and a resin binder, provided on the white ink layer.

DETAILED DESCRIPTION OF THE INVENTION

Figure 1:
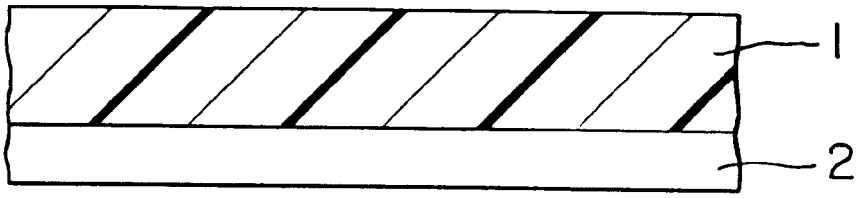
FIG. 1 is a cross-sectional view of a heat transfer white-image-printing sheet in which a white ink layer is provided on a substrate film.

A heat transfer white-image-printing sheet of the present invention is such that a white ink layer 2 comprising a resin as a main component of the binder thereof, and fine hollow particles is provided on one surface of a substrate film 1 as shown in FIG. 1.

Figure 2:
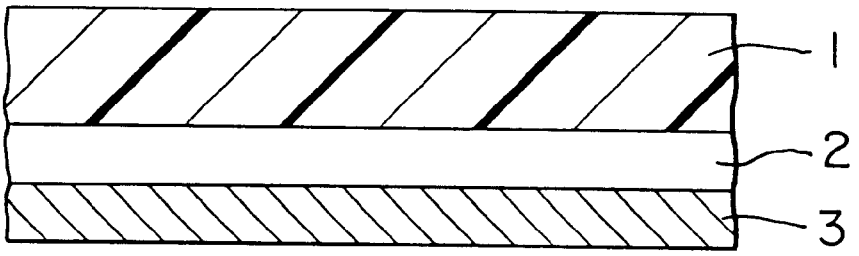
FIG. 2 is a cross-sectional view of a heat transfer white-image-printing sheet in which a white ink layer is provided on a substrate film and a heat-sensitive adhesion layer is provided on the white ink layer.

FIG. 2 shows one application of the heat transfer white-image-printing sheet of the present invention, in which a white ink layer 2 comprising a resin as a main component of the binder thereof is provided on one surface of a substrate film 1, and a heat-sensitive adhesion layer 3 comprising fine hollow particles is provided on the white ink layer 2.

Figure 3:
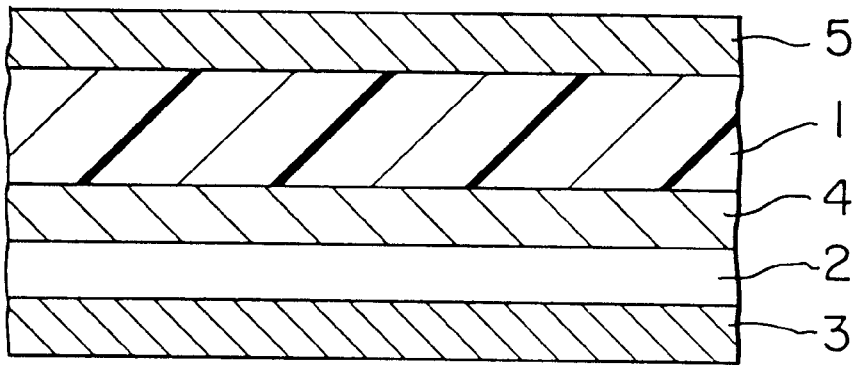
FIG. 3 is a cross-sectional view of a heat transfer white-image-printing sheet comprising a releasing layer and a sticking-preventing layer.

Further, the heat transfer white-image-printing sheet of the present invention can be obtained, if necessary, by providing a releasing layer 4, a white ink layer 2 comprising a resin as a main component of the binder thereof, and a heat-sensitive adhesion layer 3 on one surface of a substrate film 1 in the mentioned order, and a sticking-preventing layer 5 on the other surface of the substrate film 1 as shown in FIG. 3. In this printing sheet, fine hollow particles are incorporated into either the white ink layer or the heat-sensitive adhesion layer.

By providing the white ink layer comprising a resin as a main component of the binder thereof as described above, the heat transfer printing sheet can produce an image which is excellent in both abrasion resistance and heat resistance. Further, by incorporating fine hollow particles containing a gas therein into either the white ink layer or the heat-sensitive adhesion layer provided on the white ink layer, transmitted light is prevented from going straight on. Therefore, the hiding power of the heat transfer white-image-printing sheet can be improved by the synergistic effect of the fine hollow particles and a white pigment.

There is no particular limitation on the substrate film of the heat transfer white-image-printing sheet of the present invention; not only the same substrate film as used for the conventional heat transfer white-image-printing sheets but also any other substrate film can be used as long as it can endure high temperatures at the time of heat transfer printing.

Specific examples of the substrate film include films of plastics such as polyester, polypropylene, cellophane, polycarbonate, cellulose acetate, polyethylene, polyvinyl chloride, polystyrene, polyamide, polyimide, polyvinylidene chloride, polyvinyl alcohol, saponified products of ethylene-vinyl acetate copolymer, fluororesin, chlorinated rubber, ionomers, ethylene-acrylic acid copolymer and ethylene-acrylate copolymer, condenser paper, paraffin paper, non-woven fabric, aluminum foil, and composite films thereof.

The thickness of the substrate film can be suitably selected depending upon the material thereof so that strength and thermal conductivity can be properly controlled. However, a preferable thickness is from 2 to 25 micrometers.

Further, a sticking-preventing layer which can prevent the heat transfer printing sheet from sticking to a thermal head and which can ensure the stable run of the heat transfer printing sheet can also be provided on the back surface of the substrate film.

A white ink layer to be provided on the surface of the substrate film is formed by using a coating liquid which comprises a resin binder, a white pigment, fine hollow particles, and, if necessary, additives.

Alternatively, a white ink layer comprising as main components a resin binder and a white pigment is provided on the surface of the substrate film, and a heat-sensitive adhesion layer comprising fine hollow particles and a thermoplastic resin is provided on the white ink layer.

The white ink layer is thermally transferred to the surface of an image-receiving color sheet. Thus, a white-colored image is clearly printed on the image-receiving color sheet.

The resin binder for use in the present invention is suitably selected from natural resins and derivatives thereof, natural or synthetic rubber and derivatives thereof, cellulose and derivatives thereof, solvent-soluble synthetic resins which are solid at room temperature, oligomers and the like. Additives such as a plasticizer, a surface active agent and a lubricant may also be added, if necessary.

Specific examples of the resin component include polyester resin, acrylic resin, styrene-acrylic resin, styrene resin, ionomers, styrene-acrylonitrile resin, amide resin, ethylene-vinyl acetate copolymer, chlorinated polypropylene, chlorinated rubber and cyclized rubber.

Of these, chlorinated polypropylene is preferred; when it is used as a main component of the binder, an image having good edge definition can be obtained by heat transfer printing.

The white pigment used as a colorant can be suitably selected from titanium oxide (rutile type, anatase type), zinc oxide, zinc sulfide, lithopone, calcium carbonate, silica, kaolin, clay and the like.

A preferable concentration of the white pigment based on solid matter is from 200 to 1000 parts by weight for 100 parts by weight of the resin.

When the amount of the white pigment is less than 200 parts by weight, sufficiently high hiding power cannot be obtained. On the other hand, when this amount is in excess of 1000 parts by weight, some troubles related to printability, the flow properties of the ink and the like will be caused.

Further, a lubricant such as microcrystalline wax, paraffin wax or vaseline can also be added to the white ink layer in an amount of 5% or less of the binder, within such a limit that the abrasion resistance of a printed image is not marred.

Furthermore, it is preferable to use fine hollow particles containing a gas therein along with the white pigment. By this combination, transmitted light is prevented from going straight on, and hiding power can thus be improved.

In the case where the fine hollow particles and the white pigment are used in combination, the fine hollow particles can be used in an amount of 25 to 200 parts by weight for 100 parts by weight of the white pigment.

When less than 25 parts by weight of the fine hollow particles are used for 100 parts by weight of the white pigment, it is necessary to incorporate a larger amount of the white pigment into a coating liquid to obtain sufficiently high hiding power. As a result, the flow properties of the coating liquid are impaired. On the other hand, when more than 200 parts by weight of the fine hollow particles are used, some troubles will be caused; for example, high sensitivity cannot be obtained when heat transfer printing is conducted, and only poor adhesion is obtained between the ink and an image-receiving layer.

It is preferable to use a polar solvent such as an alcohol or an ester as a solvent of the coating liquid for forming a white ink layer, or to use an aqueous dispersion of a polymer composition as the binder of the coating liquid so that the coating liquid will not dissolve a releasing layer comprising a wax as a main component, provided, when necessary, between the substrate film and the white ink layer.

The white ink layer is formed by coating the coating liquid for forming a white ink layer, which comprises the above-described materials and the solvent component such as an organic solvent by a conventionally known coating method such as gravure coating, gravure reverse coating, roll coating or air-knife coating, or hot lacquer coating.

The thickness of the white ink layer depends on whitening power required. However, a preferable thickness is approximately from 2 to 6 micrometers. When the thickness of the white ink layer is less than 2 micrometers, whitening power cannot be sufficiently obtained. On the other hand, when the thickness is more than 6 micrometers, a large amount of printing energy is required, so that such a thickness is unfavorable.

In the case where a heat-sensitive adhesion layer is provided on the white ink layer as one application of the heat transfer white-image-printing sheet of the present invention, a resin binder and fine hollow particles are used to form the heat-sensitive adhesion layer.

Examples of the resin for use in the heat-sensitive adhesion layer include polyester, acrylic resin, styrene-acrylonitrile resin, amide resin and ethylene-vinyl acetate copolymer. Of these, polyester is preferred from the viewpoints of adhesion and resistance to chemicals.

It is preferable to blend 40 to 80% by weight of the fine hollow particles. When the amount of the fine hollow particles is less than 40 parts by weight, sufficiently high hiding power cannot be obtained. On the other hand, when the amount of the fine hollow particles is in excess of 80 parts by weight, adhesion is lowered.

The heat-sensitive adhesion layer is formed by coating, onto the white ink layer, a coating liquid which comprises the resin component, the fine hollow particles and a solvent component such as an organic solvent. A preferable thickness of the heat-sensitive adhesion layer is approximately from 0.3 to 3 micrometers. When the thickness of the heat-sensitive adhesion layer is less than 0.3 micrometers, adhesion to an image-receiving sheet and hiding power are impaired. On the other hand, when the thickness is in excess of 3 micrometers, not only a large amount of printing energy is required, but also sensitivity is lowered and printability is impaired.

By providing such a heat-sensitive adhesion layer, it is possible to further improve hiding power and printability.

The fine hollow particles incorporated into either the white ink layer or the heat-sensitive adhesion layer in order to improve the hiding power of the heat transfer white-image-printing sheet of the present invention are those which have a mean particle diameter of 0.2 to 2 micrometers and an inner diameter/outer diameter ratio of 0.2 to 0.8.

When fine hollow particles having a mean particle diameter of less than 0.2 micrometers are used, sufficiently high hiding power cannot be obtained. On the other hand, when fine hollow particles having a mean particle diameter of more than 2 micrometers are used, transferability may be impaired.

Further, when fine hollow particles having an inner diameter/outer diameter ratio of less than 0.2 are used, sufficiently high hiding power cannot be obtained. On the other hand, fine hollow particles having an inner diameter/outer diameter ratio of more than 0.8 are poor in strength, so that they cannot maintain their shape when printing is conducted. For this reason, sufficiently high hiding power cannot be obtained.

A resin such as styrene-acrylic resin, acrylic resin or the like can be used to make the fine hollow particles. Those particles which are made from a crosslinked resin are preferable because such particles have improved heat resistance.

The fine hollow particles show excellent dispersion stability in a coating liquid as compared with an inorganic white pigment. In the white ink layer or the heat-sensitive adhesion layer, they prevent transmitted light from going straight on. Whitening power is thus supplemented.

A releasing layer provided, when necessary, between the substrate film and the white ink layer in the heat transfer white-image-printing sheet can not only ensure the easy separation of the white ink layer from the substrate film, but also form a layer having protective properties on a printed image. The abrasion resistance and chemical resistance of the printed image can thus be improved.

The releasing layer comprises as main components a wax and a resin. Examples of the wax include paraffin wax, carnauba wax, microcrystalline wax, polyethylene wax and candelilla wax. These waxes can be used either singly or in combination of two or more. Examples of the thermoplastic resin to be blended with the wax include ethylene-vinyl acetate copolymer, acrylic resin, styrene resin, styrene-acrylonitrile resin and nitrile-butadiene rubber (NBR). These resins can be used either singly or in combination of two or more.

From 10 to 70% by weight of the thermoplastic resin can be blended. When these two components are blended in this blend ratio, a releasing layer having moderate releasability, capable of imparting abrasion resistance and chemical resistance to a printed image can be formed.

The releasing layer can have any thickness as long as no pin hole is formed therein. A preferable thickness is from 0.1 to 1 micrometer.

The present invention will now be explained more specifically by referring to the following examples. However, these examples are not intended to limit or restrict the scope of the present invention in any way.

EXAMPLE 1

A polyester film having a thickness of 4.5 micrometers was used as a substrate film 1. A coating liquid 1 for forming a white ink layer, having the following formulation was coated onto one surface of the substrate film 1 in an amount of 6 g/m$^2$ (on solid matter basis, the amount of coating will be hereinafter shown on solid matter basis, unless otherwise indicated) by means of gravure reverse coating to form a white ink layer 2. Thus, a heat transfer white-image-printing sheet of the present invention was obtained.

| Coating Liquid 1 for Forming White Ink Layer | |
|---|---|
| Titanium oxide | 60 parts by weight |
| Polyester ("Vylon 200" manufactured by Toyobo Co., Ltd.) | 30 parts by weight |
| Fine hollow particles ("MH5055" manufactured by Nippon Zeon Co., Ltd., particle diameter = 0.5 micrometers, inner diameter/outer diameter = 0.82) | 50 parts by weight |
| Water | 300 parts |

EXAMPLE 2

A polyester film having a thickness of 6 micrometers was used as a substrate film 1. A coating liquid 2 for forming a white ink layer, having the following formulation was coated onto one surface of the substrate film 1 in an amount of 5 g/m$^2$ by means of gravure reverse coating to form a white ink layer 2. Thereafter, a coating liquid 1 for forming a heat-sensitive adhesion layer, having the following formulation was coated onto the surface of the white ink layer 2 in an amount of 2 g/m$^2$ to form a heat-sensitive adhesion layer 3. Thus, a heat transfer white-image-printing sheet of the present invention was obtained.

| Coating Liquid 2 for Forming White Ink Layer | |
|---|---|
| Titanium oxide | 90 parts by weight |
| Chlorinated polypropylene | 30 parts by weight |
| Toluene | 80 parts by weight |

| Coating Liquid 1 for Forming Heat-Sensitive Adhesion Layer | |
|---|---|
| Acrylic resin ("AE-120" manufactured by Japan Synthetic Rubber Co., Ltd.) | 50 parts by weight |
| Fine hollow particles ("MH5055" manufactured by Nippon Zeon Co., Ltd.) | 50 parts by weight |
| Water | 120 parts by weight |

EXAMPLE 3

A polyester film having a thickness of 4.5 micrometers was used as a substrate film 1. A coating liquid 1 for forming a releasing layer, having the following formulation was coated onto one surface of the substrate film 1 in an amount of 0.5 g/m$^2$ by means of gravure coating to form a releasing layer 4. Subsequently, the above-described coating liquid 2 for forming a white ink layer was coated onto the surface of the releasing layer 4 in an amount of 6 g/m$^2$ by means of gravure reverse coating to form a white ink layer 2. Thereafter, a coating liquid 2 for forming a heat-sensitive adhesion layer, having the following formulation was coated onto the surface of the white ink layer 2 in an amount of 2 g/m$^2$ to form a heat-sensitive adhesion layer 3. Thus, a heat transfer white-image-printing sheet of the present invention was obtained.

| Coating Liquid 1 for Forming Releasing Layer | |
|---|---|
| Carnauba wax | 45 parts by weight |
| EVA ("Sumitate KA-10" manufactured by Sumitomo Chemical Co., Ltd.) | 55 parts by weight |
| Water | 120 parts by weight |

| Coating Liquid 2 for Forming Heat-Sensitive Adhesion Layer | |
|---|---|
| Polyester | 40 parts by weight |
| Fine hollow particles ("JSR 863" manufactured by Japan Synthetic Rubber Co., Ltd., particle diameter = 0.35 micrometers, inner diameter/outer diameter = 0.66) | 60 parts by weight |
| Water | 120 parts by weight |

COMPARATIVE EXAMPLE 1

A polyester film having a thickness of 4.5 micrometers was used as a substrate film 1. A coating liquid 3 for forming a white ink layer, having the following formulation was coated onto one surface of the substrate film 1 in an amount of 6 g/m$^2$ by means of gravure reverse coating to form a white ink layer 2. Thus, a comparative heat transfer white-image-printing sheet was obtained.

| Coating Liquid 3 for Forming White Ink Layer | |
|---|---|
| Titanium oxide | 60 parts by weight |
| Polyester | 30 parts by weight |
| Water | 180 parts by weight |

COMPARATIVE EXAMPLE 2

A polyester film having a thickness of 4.5 micrometers was used as a substrate film 1. A coating liquid 1 for forming a releasing layer, having the formulation in Example 3 was coated onto one surface of the substrate film in an amount of 0.5 g/m$^2$ by means of gravure coating to form a releasing layer 4. Subsequently, the above-described coating liquid 2 for forming a white ink layer was coated onto the surface of the releasing layer 4 in an amount of 6 g/m$^2$ by means of gravure reverse coating to form a white ink layer 2. Thereafter, a coating liquid 3 for forming a heat-sensitive adhesion layer, having the following formulation was coated onto the surface of the white ink layer 2 in an amount of 2 g/m$^2$ to form a heat-sensitive adhesion layer 3. Thus, a comparative heat transfer white-image-printing sheet was obtained.

| Coating Liquid 3 for Forming Heat-Sensitive Adhesion Layer | |
|---|---|
| Polyester | 40 parts by weight |
| Water | 120 parts by weight |

Printing was conducted by using each of the above-obtained heat transfer white-image-printing sheets of the present invention and comparative ones, and the resulting printed materials were evaluated in hiding power, sensitivity and abrasion resistance.

<Methods and Standards for Evaluation>

Hiding power: An image was printed on a red-colored label having a density of 1.54, measured by a Macbeth densitometer RD 914 using a green filter. The density of red color on the image-printed area was measured by the densitometer.

Sensitivity: An image was printed by a bar code printer, and read by a reader.

Abrasion resistance: A stainless-steel-made ball loaded with 300 g was used. After a printed image was rubbed ten times by the reciprocating motion of the ball, the image was observed to see whether the falling of the ink had faded.

The results of the above tests are shown in Table 1.

TABLE 1

| Sample | Hiding Power | Sensitivity | Abrasion Resistance |
|---|---|---|---|
| Example 1 | 0.25 | ○ | ○ |
| Example 2 | 0.20 | ○ | ○ |
| Example 3 | 0.19 | ○ | ○ |
| Comp. Ex. 1 | 0.37 | ○ | ○ |
| Comp. Ex. 2 | 0.28 | ○ | ○ |

Since the present invention has the above-described structure, the following effects can be obtained.

When fine hollow particles are incorporated into a white ink layer or a heat-sensitive adhesion layer contained in a heat transfer white-image-printing sheet, they prevent transmitted light from going straight on. Therefore, the heat transfer printing sheet can produce white-colored images having improved hiding power. Further, by providing a releasing layer by the use of a mixture of a resin having high adhesion to a substrate film and a wax, a heat transfer white-image-printing sheet free from flaking, having good transferability, capable of producing images which are excellent in abrasion resistance can be obtained.

What is claimed is:

1. A heat transfer white-image-printing sheet comprising:

a substrate film; and a white ink layer provided on a surface of said substrate film, and comprising 100 parts by weight of a resin, 200–1000 parts by weight of a white pigment based on the amount of said resin, and 25–200 parts by weight of fine hollow particles based on 100 parts by weight of said white pigment, said fine hollow particles comprising a crosslinked resin.

2. The heat transfer white-image-printing sheet according to claim 1, wherein said fine hollow particles have an inner diameter/outer diameter ratio of 0.2 to 0.8.

* * * * *